United States Patent [19]

Levinson

[11] Patent Number: 4,638,284

[45] Date of Patent: Jan. 20, 1987

[54] TUBULAR VARISTOR ARRANGEMENT

[75] Inventor: Lionel M. Levinson, Schenectady, N.Y.

[73] Assignee: General Electric Corp., Schenectady, N.Y.

[21] Appl. No.: 678,726

[22] Filed: Dec. 5, 1984

[51] Int. Cl.[4] ..... H01C 7/10

[52] U.S. Cl. ..... 338/21; 338/51

[58] Field of Search ..... 338/21, 51, 52, 20; 361/127, 126; 323/352, 353, 354

[56] References Cited

U.S. PATENT DOCUMENTS

| | | | |
|---|---|---|---|
| 857,849 | 6/1907 | Titus | 338/21 |
| 1,063,303 | 6/1913 | Thomson | 338/21 |
| 3,227,983 | 1/1966 | Braun | 338/21 |
| 4,276,578 | 6/1981 | Levinson et al. | 338/21 X |
| 4,335,417 | 6/1982 | Sakshang et al. | 338/21 X |

OTHER PUBLICATIONS

Sales brochure FC-30 titled "Filter Connectors", Amphenol (Bunker Ramo); Amphenol North America-Amphenol Canada, Inc., p. 13.

*Primary Examiner*—E. A. Goldberg
*Assistant Examiner*—M. M. Lateef
*Attorney, Agent, or Firm*—John R. Rafter; James C. Davis, Jr.; Marvin Snyder

[57] ABSTRACT

A tubular varistor arrangement, particularly suitable for use in electrical connectors of circular cross-section, attains an electrical breakdown voltage equalling the cumulation of the breakdown voltages of multiple varistor sections of the arrangement. The varistor arrangement includes a plurality of tubular varistor sections that are interconnected in electrical serial relationship.

5 Claims, 1 Drawing Figure

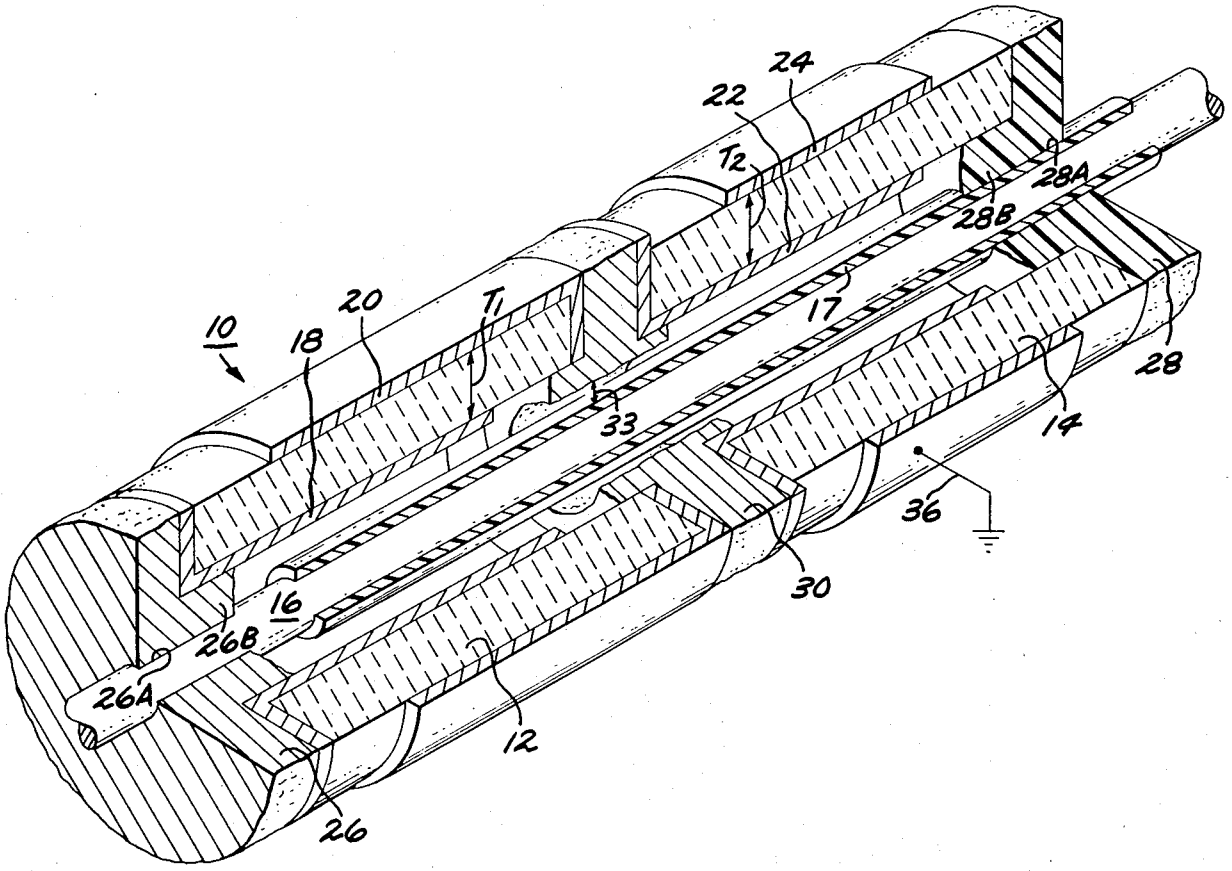
28
28A
28B
14
36
24
22
12
17
30
33
71
12
20
18
16
26
10
26B
26A

TUBULAR VARISTOR ARRANGEMENT

The government has rights in this invention pursuant to Contract No. F29601-82-C-0027 awarded by the Department of the Air Force.

BACKGROUND OF THE INVENTION

The present invention relates to a tubular varistor arrangement, and, more particularly, to a varistor arrangement suitable for use in an electrical connector of circular cross-section.

Presently-available electrical connectors that are circular in cross-section are typically restricted in the wall thickness of tubular electrical circuit elements which can be integrated into the connectors. This is a result of the considerable capital costs associated with design and acquisition of the various machine tools required to produce a circular connector. Various power and signal level electrical systems incorporating circular connectors, however, require respective varistor breakdown voltages that are incompatible with tubular varistors of presently-available compositions subject to a typical restriction on tubular wall thickness. This is because varistor breakdown voltage varies according to the thickness of varistor material between a pair of spaced electrodes. While it would be possible to comply with the foregoing tubular wall thickness-restriction by formulating varistor compositions of desired breakdown voltage for a specified wall thickness, it would be desirable to utilize presently-available varistor compositions, since these have been exhaustively optimized in regard to a comprehensive range of performance parameters.

SUMMARY OF THE INVENTION

Accordingly, an object of the invention is to provide a tubular varistor arrangement that may utilize standard varistor compositions for application in a circular connector subject to a tubular wall thickness-restriction.

Another object of the invention is to provide a tubular varistor arrangement for application in a tubular wall thickness-restricted electrical connector that can be fabricated without expensive retooling for producing the connector.

A further object of the invention is to provide a tubular varistor arrangement having a break-down voltage of several times that of any single tubular varistor of the arrangement.

The foregoing and further objects of the invention are realized, in preferred form, in a tubular varistor arrangement comprising first and second tubular varistor sections aligned with each other. A center conductor is disposed generally concentrically within the first and second varistor sections. First and second tubular electrodes adjoin the inner and outer radial surfaces, respectively, of the first varistor section, while third and fourth tubular electrodes adjoin the inner and outer radial surfaces, respectively, of the second varistor section. The first tubular electrode is electrically shorted to the center conductor; the second tubular electrode is electrically shorted to the third tubular electrode, while being electrically isolated from the center electrode; and the fourth tubular electrode is electrically shorted to a reference potential conductor.

The foregoing tubular varistor arrangement attains a breakdown voltage constituting the combined breakdown voltages of the first and the second varistor sections.

BRIEF DESCRIPTION OF THE DRAWING

While the specification concludes with claims defining the features of the invention regarded as novel, the invention itself, as to both organization and method of operation, will be better understood from the following description, in conjunction with the sole drawing FIGURE, depicting a tridimensional view of a preferred tubular varistor arrangement, a portion of the arrangement being cut away to illustrate more clearly details of the present invention.

DESCRIPTION OF THE PREFERRED EMBODIMENTS

A tubular varistor arrangement 10 is depicted in the sole drawing FIGURE. Varistor arrangement 10 includes first and second tubular varistor sections 12 and 14, respectively, aligned with each other along their longitudinal axes. A center conductor 16, such as copper, is disposed generally concentrically within varistor sections 12 and 14. Center conductor 16 is preferably coated with electrical insulation 17, such as high dielectric strength paper or heat-shrink polymer.

A tubular electrode 18 adjoins the radially inner surface of tubular varistor section 12, and a tubular electrode 20 adjoins the radially outer surface of varistor section 12. Similarly, tubular electrodes 22 and 24 adjoin the inner and outer radial surfaces, respectively, of tubular varistor section 14. These various tubular electrodes (i.e., electrodes 18, 20, 22 and 24) may comprise a deposited silver or aluminum layer on the respective surfaces of varistor sections 12 and 14, by way of example.

Varistor sections 12 and 14 are mechanically supported relative to center conductor 16 by support members 26 and 28. Support member 26 includes an aperture 26A, in which center conductor 16 is rigidly disposed. Support member 26 further includes a tubular flange 26B, onto which the radially inner surface of varistor 12 is mechanically supported via tubular electrode 18. As with support member 26, support member 28 includes an aperture 28A, into which insulation-coated center conductor 16 is rigidly disposed. Support member 28 further includes a tubular flange 28B, onto which the radially inner surface of thyristor section 14 is affixed.

An intermediate support member 30 is interposed between tubular varistor sections 12 and 14. Support member 30 is spaced from center conductor 16 by insulation layer 17, and may additionally be separated from conductor 16 by an air gap 33.

Support members 26 and 30 comprise electrically-conductive material; for example, solder, or a conductive elastomer, such as silver-filled silicone. Support member 28 comprises an electrically-insulating material; for example, an elastomer of silicone.

To achieve the desired breakdown voltage for tubular varistor assembly 10, inner electrode 18 is electrically shorted to center conductor 16, via conductive support member 26; outer electrode 20 is electrically shorted to inner electrode 22, via conductive support member 30; and outer electrode 24 is electrically shorted to a reference, or ground, potential conductor 36 (illustrated schematically).

The breakdown voltage of varistor arrangement 10 is effectively twice that of either varistor section 12 or 14. This is because the use of two varistor sections 12 and 14, electrically interconnected as described herein, places the varistors sections in a serial circuit relationship. Accordingly, the respective breakdown voltages of varistor sections 12 and 14, which are proportional to the respective thicknesses $T_1$ and $T_2$ of the varistor sections, cumulate to yield the same breakdown voltage as could be provided by a varistor of thickness $T_1+T_2$.

The foregoing describes a varistor arrangement that attains a breakdown voltage of several times that of a single tubular varistor of the arrangement. The varistor arrangement is particularly beneficial in presently-available electrical connectors of circular cross-section, in which varistor material of standard composition may be used without altering the dimensions of the electrical connectors.

While the invention has been described with respect to specific embodiments by way of illustration, many modifications and changes will occur to those skilled in the art. For example, more than two varistor sections could be employed in a tubular varistor arrangement to achieve a commensurate increase in total breakdown voltage. Additionally, various parts described herein as being "tubular" need not be perfectly tubular in configuration; accordingly, for instance, a tubular electrode may only partially circumscribe a varistor section. It is, therefore, to be understood that the appended claims are intended to cover all such modifications and changes as fall within the true spirit and scope of the invention.

What is claimed as the invention and desired to be secured by Letters Patent of the United States is:

1. A tubular varistor arrangement, comprising:

(a) first and second generally tubular varistor sections, aligned with each other;

(b) a center conductor disposed, generally concentrically, within said first and second varistor sections;

(c) first and second generally tubular electrodes respectively adjoining the radially inner and the radially outer surfaces of said first varistor section; and (d) third and fourth generally tubular electrodes respectively adjoining the radially inner and radially outer surfaces of said second varistor section;

(e) said first tubular electrode being electrically shorted to said center conductor, said second tubular electrode being electrically shorted to said third tubular electrode, and said fourth tubular electrode being electrically shorted to a reference potential conductor, whereby the varistor breakdown voltage between said center conductor and said reference potential conductor constitutes the cumulation of breakdown voltages of said first and second varistor sections.

2. The tubular varistor arrangement of claim 2, further comprising an electrically-conductive support member, including an aperture in which said central conductor is rigidly disposed; and a generally tubular flange mechanically supporting the radially inner portion of said first varistor section.

3. The tubular varistor arrangement of claim 2, further comprising an electrically-insulating support member, including an aperture in which said central conductor is rigidly disposed; and a generally tubular flange mechanically supporting the radially inner portion of said second varistor section.

4. The tubular varistor arrangement of claim 3, further comprising an additional electrically-conductive support member interposed between, and mechanically supporting in rigid fashion, said first and second varistor sections.

5. The tubular varistor arrangement of claim 4, further comprising an insulating layer surrounding said center conductor and electrically isolating said third tubular electrode from said center conductor.

* * * * *

UNITED STATES PATENT AND TRADEMARK OFFICE

CERTIFICATE OF CORRECTION

PATENT NO. : 4,638,284

DATED : January 20, 1987

INVENTOR(S) : Lionel M. Levinson

It is certified that error appears in the above-identified patent and that said Letters Patent is hereby corrected as shown below:

Cover page, line [73], the name of the assignee should read -- General Electric Company, Schenectady, N.Y. --.

Signed and Sealed this

Eighteenth Day of August, 1987

*Attest:*

DONALD J. QUIGG

*Attesting Officer*

*Commissioner of Patents and Trademarks*